US010235869B2

(12) United States Patent
Yamamoto et al.

(10) Patent No.: US 10,235,869 B2
(45) Date of Patent: Mar. 19, 2019

(54) REMOTE CONTROL DEVICE

(71) Applicant: DAIKIN INDUSTRIES, LTD., Osaka-shi, Osaka (JP)

(72) Inventors: Ryousuke Yamamoto, Sakai (JP); Mario Hayashi, Sakai (JP); Yasuaki Kobayashi, Sakai (JP); Tatsuya Higuchi, Sakai (JP); Ryouji Inoue, Sakai (JP); Yukio Inoue, Sakai (JP); Natsuko Kitagawa, Sakai (JP); Takeshi Yoshimura, Sakai (JP); Asuka Yagi, Sakai (JP); Youta Katou, Sakai (JP)

(73) Assignee: Dalkin Industries, Ltd., Osaka (JP)

( * ) Notice: Subject to any disclaimer, the term of this patent is extended or adjusted under 35 U.S.C. 154(b) by 0 days.

(21) Appl. No.: 15/316,973

(22) PCT Filed: Jun. 3, 2015

(86) PCT No.: PCT/JP2015/065994
§ 371 (c)(1),
(2) Date: Dec. 7, 2016

(87) PCT Pub. No.: WO2015/190359
PCT Pub. Date: Dec. 17, 2015

(65) Prior Publication Data

US 2017/0122618 A1 May 4, 2017

(30) Foreign Application Priority Data

Jun. 9, 2014 (JP) ..... 2014-118264

(51) Int. Cl.
*G08C 17/02* (2006.01)
*F24F 11/89* (2018.01)
(Continued)

(52) U.S. Cl.
CPC ..... *G08C 17/02* (2013.01); *F24F 11/89* (2018.01); *F24F 11/52* (2018.01); *F24F 11/56* (2018.01)

(58) Field of Classification Search
CPC ..... G08C 17/02; G06F 3/0416
See application file for complete search history.

(56) References Cited

U.S. PATENT DOCUMENTS 5,295,062 A * 3/1994 Fukushima ..... G06F 9/4446 345/173
2002/0039094 A1* 4/2002 Yamada ..... G06F 3/045 345/173

(Continued)

FOREIGN PATENT DOCUMENTS

EP 2 725 654 A1 4/2014
JP 3171994 U 11/2011

(Continued)

OTHER PUBLICATIONS

International Preliminary Report of corresponding PCT Application No. PCT/JP2015/065994 dated Jun. 3, 2015.

(Continued)

*Primary Examiner* — Vernal U Brown
(74) *Attorney, Agent, or Firm* — Global IP Counselors, LLP

(57) ABSTRACT

A remote control device configured communicate with an air conditioner or a heat pump includes a touch panel having an electrode unit, a liquid crystal display, and a casing accommodating the touch panel and the liquid crystal display. The casing has a back surface part and a front surface part. The liquid crystal display is disposed to overlap the touch panel as seen from a front surface part side. The electrode unit has a first electrode section to detect a touched position, and a second electrode section that may function as an antenna to perform wireless communication with another communica- (Continued)

tion device. The first and second electrode sections are configured and arranged to be nearer to the front surface part than to the back surface part inside the casing, and to be disposed so as not to overlap with each other as seen from the front surface part side.

12 Claims, 8 Drawing Sheets

(51) Int. Cl.
*F24F 11/56* (2018.01)
*F24F 11/52* (2018.01)

(56) References Cited

U.S. PATENT DOCUMENTS

2012/0068832 A1* 3/2012 Feldstein ..... F16M 11/041 340/12.5
2013/0018513 A1 1/2013 Metselaar
2013/0196596 A1 8/2013 Parekh et al.
2013/0285797 A1 10/2013 Paulsen et al.
2014/0073270 A1 3/2014 Chou et al.
2014/0074537 A1* 3/2014 Bargetzi ..... G08C 17/02 705/7.19
2014/0298225 A1* 10/2014 Senda ..... G06F 3/0484 715/768
2017/0122618 A1 5/2017 Yamamoto et al.

FOREIGN PATENT DOCUMENTS

JP 2013-017108 A 1/2013
JP 2013-239164 A 11/2013
JP 2015230161 A 12/2015

OTHER PUBLICATIONS

International Search Report of corresponding PCT Application No. PCT/JP2015/065994 dated Sep. 1, 2015.
European Search Report of corresponding EP Application No. 15 80 6603.5 dated Jan. 23, 2018.

* cited by examiner

REMOTE CONTROL DEVICE

CROSS-REFERENCE TO RELATED APPLICATIONS

This U.S. National stage application claim priority under 35 U.S.C. § 119 (a) to Japanese Patent Application No. 2014-118264, filed in Japan on Jun. 9,2014, the entire contents of which are hereby incorporated herein by reference.

TECHNICAL FIELD

The present invention relates to a remote control device.

BACKGROUND ART

In the prior art, there are communication devices capable of wireless communication with other communication devices. For example, Japanese Patent Application Laid-open No 2013-17108 discloses a communication device configured to carry out wireless communication with other communication devices. In the communication device of Japanese Patent Application Laid-open No. 2013-17108, touch panel and a display being disposed on the front surface side of a main unit and an antenna for wireless communication being disposed on a back surface side of the main unit.

SUMMARY

Technical Problem

However, it is conceivable that when the communication device of Japanese Patent Application Laid-open No. 2013-17108 is used as a sidewall-installed typed remote control device of an air conditioner or a heat pump apparatus, the antenna for wireless communication will be positioned on the back surface (sidewall) side of the main unit, and that function of the antenna in near field communication (NFC) or other wireless communication is likely to be inhibited and wireless communication performance will be degraded. On the other hand, when the antenna for wireless communication is disposed on the front surface side of the main unit, the surface area of the display is reduced because it is required to secure space for disposing the antenna and operability is likely to be degraded. In such a case, costs are increased with installation of the antenna for wireless communication in addition to the touch panel.

In view of the above, an object of the present invention is to provide a remote control device that restrains performance degradation and cost increase.

Solution to Problem

A remote control device according to a first aspect of the present invention is installed on a sidewall forming an indoor space and is configured to perform wired communication with an air conditioner or a heat pump apparatus, and has a touch panel, a liquid crystal display, and a casing. The touch panel has an electrode unit. The casing is configured and arranged to accommodate the touch panel and the liquid crystal display. The casing has a back surface part and a front surface part. The back surface part faces the sidewall in an installed state. The front surface part faces the indoor space in the installed state. The liquid crystal display is disposed so as to overlap the touch panel as seen from the front surface part side. The electrode unit has a first electrode section and a second electrode section. The first electrode section is configured and arranged to function as an electrode for detecting a touched position. The second electrode section is configured and arranged to function as an antenna for performing wireless communication with another communication device The first electrode section and the second electrode section are configured and arranged to be nearer to the front surface part than to the back surface part inside the casing The first electrode section and the second electrode section are disposed so as not to overlap with each other as seen from the front surface part side In the remote control device according to the first aspect of the present invention, the touch panel includes the electrode unit, and the electrode unit has the first electrode section that functions as an electrode for detecting a touched position, and the second electrode section that functions as the antenna for performing wireless communication with another communication device. Therefore, a portion of the electrode unit of the touch panel functions as the antenna for wireless communication. As a result, an antenna is not required to be disposed in addition to the electrode unit of the touch panel, and costs are restrained.

Also, in the remote control device according to the first aspect of the present invention, the first electrode section and the second electrode section are nearer to the front surface part than to the back surface part inside the casing, and are disposed so as not to overlap with each other as seen from the front surface part side. Therefore, the second electrode unit readily demonstrates a function as the antenna and a decline in communication performance can be restrained in near field communication (NFC) or other wireless communication. Also, there is no need to reduce the surface area of the liquid crystal display and a degradation of operability is restrained.

A remote control device according to a second aspect of the present invention is configured to perform communication with an air conditioner or a heat pump apparatus, and has a touch panel, a liquid crystal display, and a casing. The touch panel has an electrode unit. The casing is configured and arranged to accommodate the touch panel and the liquid crystal display. The casing is an enclosure in which the length in a thickness direction is less than the length in a longitudinal direction and the length in a lateral direction. The casing has a front surface part and a back surface part. The front surface part is configured and arranged to constitute one principal plane of the casing. The back surface part is configured and arranged to constitute another principal plane of the casing. The back surface part is configured and arranged to face the front surface part. The liquid crystal display is disposed so as to overlap the touch panel as seen from the front surface part side. The electrode unit has a first electrode section and a second electrode section. The first electrode section is configured and arranged to function as an electrode for detecting a touched position. The second electrode section is configured and arranged to function as an antenna for performing wireless communication with another communication device. The first electrode section and the second electrode section are configured and arranged to be nearer to the front surface part than to the back surface part inside the casing. The first electrode section and the second electrode section are disposed so as not to overlap with each other as seen from the front surface part side.

In the remote control device according to the second aspect of the present invention, the touch panel includes the electrode unit, and the electrode unit has the first electrode section that functions as the electrode for detecting the touched position, and the second electrode section that functions as the antenna for performing wireless communication with another communication device. Therefore, a portion of the electrode unit, of the touch panel functions as the antenna for wireless communication. As a result, an antenna is not required to be disposed in addition to the electrode unit of the touch panel, and costs are restrained.

Also, in the remote control device according to the second aspect of the present invention, the first electrode section and the second electrode section are nearer to the front surface part than to the back surface part inside the casing, and are disposed so as not to overlap with each other as seen from the front surface part side. Therefore, the second electrode unit readily demonstrates a function as an antenna and a decline in communication performance can be restrained in near field communication (NFC) or other wireless communication. Also, there is no need to reduce the surface area of the liquid crystal display and a degradation of operability is restrained.

A remote control device according to a third aspect of the present invention is the remote control device according to the first or second aspect, wherein the touch panel furthermore has a ground section. The ground section is configured and arranged to be connected to ground. The ground section is configured and arranged to be positioned between the first electrode section and the second electrode section as seen from the front surface part side.

In the remote control device according to the third aspect of the present invention, the touch panel has the ground section positioned between the first electrode section and the second electrode section as seen from the front surface part side. Therefore, the second electrode section is less likely to be affected by noise from the first electrode section and more readily demonstrates a function as an antenna. Accordingly, decline in communication performance is further restrained.

A remote control device according to a fourth aspect of the present invention is the remote control device according to any of the first to third aspects, wherein the wireless communication is near field communication (NFC).

In the remote control device according to the fourth aspect of the present invention, wireless communication is near field communication (NFC). Therefore, cost increase and performance decline are restrained in a remote control device that performs near field communication with another communication device.

Near field communication (NFC) is a communication scheme that enables bidirectional communication at a short distance of several centimeters to about one meter using a frequency of 13.56 MHz, and is one international standard.

A remote control device according to a fifth aspect of the present invention is the remote control device according to any of the first to fourth aspects, and further has a touch detector. The touch detector is configured and arranged to detect a touched position on the touch panel. The touch detector is configured and arranged to stop the detection while wireless communication is being carried out.

In the remote control device according to the fifth aspect of the present invention, the touch detector is furthermore provided for detecting the touched position on the touch panel, and the touch detector stops the detection while wireless communication is being carried out. Therefore, the second electrode section is less likely to be affected by noise during wireless communication with another communication device and a decline in communication performance is further restrained.

A remote control device according to a sixth aspect of the present invention is the remote control device according to any of the first to fifth aspects, and further has a backlight controller. The backlight controller is configured and arranged to control backlight actuation of the liquid crystal display. The backlight controller is configured and arranged to light the backlight of the liquid crystal display in a predetermined color when the wireless communication is being carried out.

In the remote control device according to the sixth aspect of the present invention, the backlight controller lights the backlight of the liquid crystal display in a predetermined color when the wireless communication is being carried out. Therefore, when wireless communication is carried out with another communication device, an operator can more readily recognize that wireless communication is being earned out with another communication device and operability is improved.

A remote control device according to a seventh aspect of the present invention is the remote control device according to any of the first to sixth aspects, wherein the wireless communication is carried out when various settings of the air conditioner or the heat pump apparatus are carried out via the communication device.

In the remote control device according to the seventh aspect of the present invention, the wireless communication is carried out when various settings of the air conditioner or the heat pump apparatus are earned out via the communication device. Therefore, it is possible to select a variety of input means when various settings of the air conditioner or the heat pump apparatus are carried out, and operability is improved. It is also possible to reduce the amount of memory in the main body of the remote control, and costs can be restrained.

Advantageous Effects of Invention

In the remote control device according to the first aspect of the present invention, an antenna is not required to be disposed in addition to the electrode unit of the touch panel, and costs can be restrained. A decline in communication performance can be restrained in near field communication (NFC) or other wireless communication. Also, there is no need to reduce the surface area of the liquid crystal display and a degradation of operability can be restrained.

In the remote control device according to the second aspect of the present invention, an antenna is not required to be disposed in addition to the electrode unit of the touch panel, and costs are restrained. A decline in communication performance can be restrained in near field communication (NFC) or other wireless communication. Also, there is no need to reduce the surface area of the liquid crystal display and a degradation of operability is restrained.

In the remote control device according to the third aspect of the present invention, decline in communication performance is further restrained.

In the remote control device according to the fourth aspect of the present invention, cost increase and performance decline are restrained in a remote control device that performs near field communication with another communication device.

In the remote control device according to the fifth aspect of the present invention, a decline in communication performance is further restrained.

In the remote control device according to the sixth aspect of the present invention, operability is improved.

In the remote control device according to the seventh aspect of the present invention, operability is improved and costs are restrained.

DESCRIPTION OF EMBODIMENTS

The remote control device 30 according to an embodiment of the present invention is described below with reference to the drawings. It should be noted that the following embodiment is a specific example of the present invention, is not intended to limit the technical scope of the present invention, and can be appropriately changed without departing from the spurt of the invention. Additionally, in the following embodiment, the directional terms "up", "down", "left", "right", "front surface (forward)", and "back surface (rear)" mean directions depicted in the direction shown in FIGS. 3, 4, and 8.

The remote control device 30 in the present embodiment (hereinafter described as "remote control 30") is employed to an air-conditioning system 100.

(1) Air-Conditioning System 100

Figure 1:
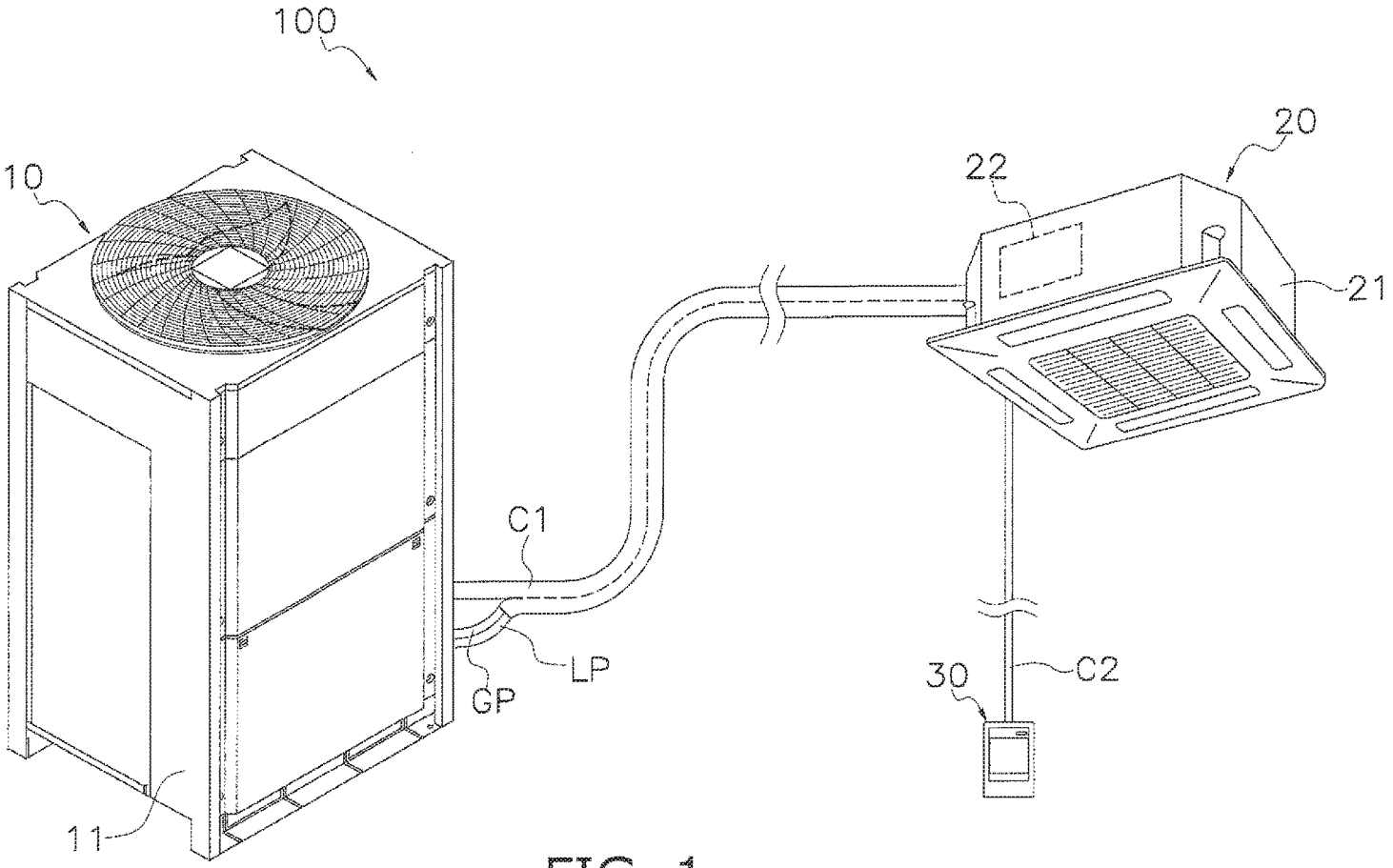
FIG. 1 is a schematic structural view of an air-conditioning system having a remote control device according to an embodiment of the present invention.
Figure 2:
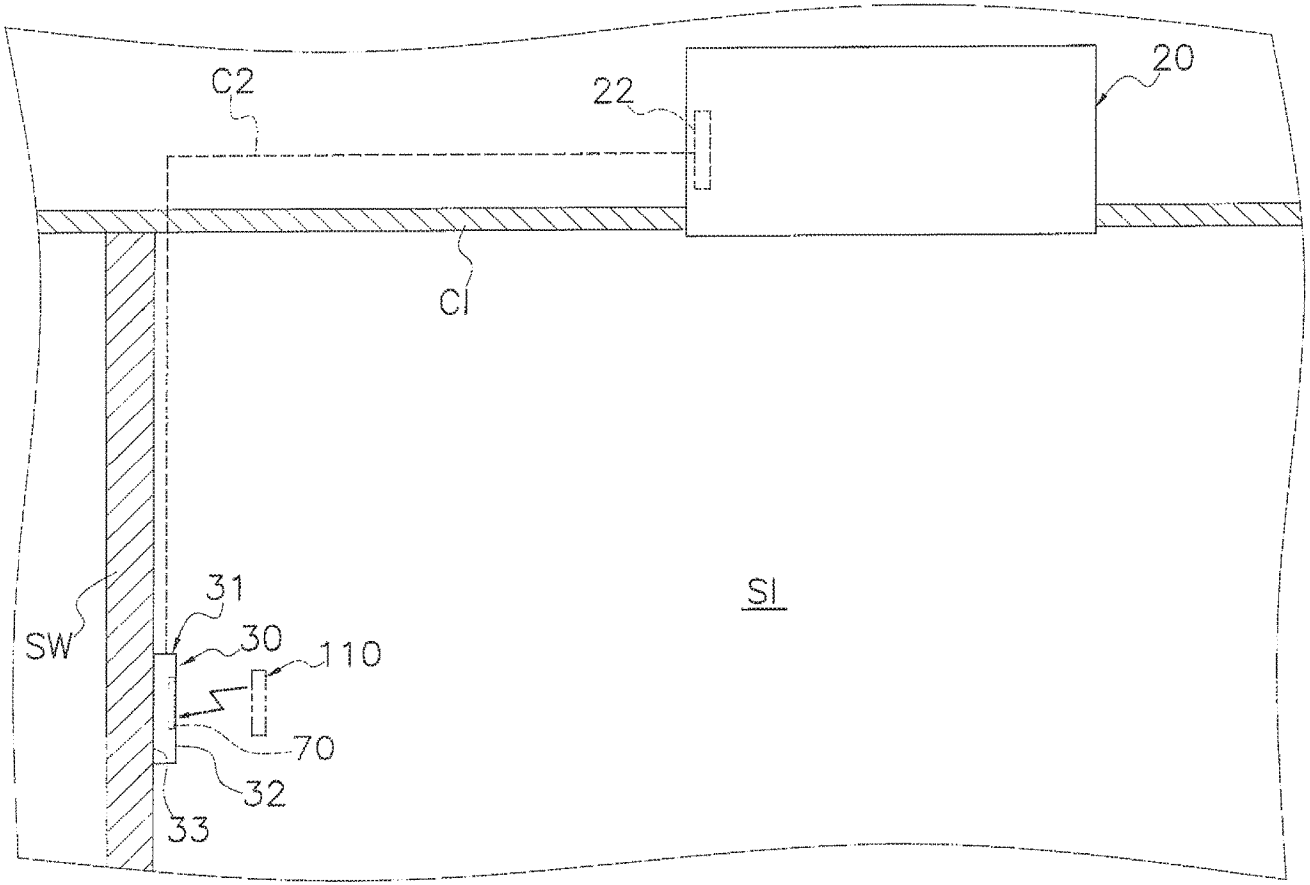
FIG. 2 is a schematic view showing an indoor unit and remote control device in an installed state.

FIG. 1 is a schematic structural view of an air-conditioning system 100 having a remote control 30. FIG. 2 is a schematic view showing an indoor unit 20 and the remote control 30 in an installed state.

The air-conditioning system 100 is an air-conditioning system having a refrigerant tube type, and performs a refrigerant cycle operation in a vapor compression scheme to perform air conditioning in a space to be air-conditioned. In the present embodiment, the air-conditioning system 100 performs air conditioning in an indoor space SI. The air-conditioning system 100 has an air-cooling mode, and an air-warming mode, a dehumidification mode and the like as operating modes, and air-cooling operation, air-warming operation, dehumidifying operation and the like are carried out in accordance with the selection operating mode.

The air-conditioning system 100 is mainly provided with an outdoor unit 10, an indoor unit 20, and a remote control 30. In the air-conditioning system 100, the outdoor unit 10 and the indoor unit 20 are connected with a liquid-refrigerant pipe LP and a gas-refrigerant pipe GP, thereby constituting a refrigerant circuit.

(1-1) Outdoor Unit 10

The outdoor unit 10 is installed on a veranda, in a basement, and/or other outdoor location. The outdoor unit 10 has a substantially rectangular parallelepiped-shaped outdoor unit casing 11. The outdoor unit 10 mainly accommodates a compressor, a four-way valve, an outdoor heat exchanger an expansion valve, an outdoor fan, an outdoor power source section, an outdoor unit controller, and the like (not shown), in the outdoor unit casing 11.

The compressor is a mechanism for taking in low-pressure gas refrigerant, and compressing and discharging the gas refrigerant. The four-way valve switches the direction of refrigerant flow when a switch is made between air-cooling operation and air-warming operation. The outdoor heat exchanger functions as a refrigerant compressor dining air-cooling operation, and functions as a refrigerant evaporator during air-warming operation. The expansion valve decompresses high-pressure refrigerant. The expansion valve is a motor-operated valve whose valve opening is regulated in accordance with operating conditions or the like. The outdoor fan generates an airflow that flows from the exterior into the outdoor unit 10, passes through the outdoor heat exchanger, and then flows out to the exterior of the outdoor unit 10. The outdoor power source section is connected to an external power source so as to be provided with a power source.

The outdoor unit controller includes a microcomputer composed of a CPU, memory, and the like. The outdoor unit controller controls the operation of equipment in the outdoor unit 10. The outdoor unit controller is connected by a cable C1 to an indoor unit controller 22 (described later) and transmits and receives signals with each other.

(1-2) Indoor Unit 20

The indoor unit 20 is, e.g., a "ceiling-embedded-type," "ceiling-suspended-type," or "wall-mounted-type" indoor unit. In the present embodiment, the indoor unit 20 is a ceiling-embedded-type. The indoor unit 20 is installed behind the ceiling so as to be exposed a blow port and/or intake grill from the ceiling CI in the indoor space SI. The outer shell of the indoor unit 20 is composed of an indoor unit casing 21. The indoor unit 20 accommodates an indoor heat exchanger (not shown), an indoor fan (not shown), an indoor power source section (not shown), the indoor unit controller 22, and the like, in the indoor unit casing 21.

The indoor heat exchanger functions as a refrigerant evaporator during air-cooling operation, and functions as a refrigerant condenser during air-warming operation. The indoor fan is a blower that generates an airflow that flows into the indoor unit 20, passes through the indoor heat exchanger, and then flows out to the exterior of the indoor unit 20. The indoor power source section is connected to an outdoor power source so as to be provided with a power source.

The indoor unit controller 22 includes a microcomputer composed of a CPU, memory, and the like. The indoor unit controller 22 is connected to the outdoor unit controller via the cable C1, and transmits and receives signals with each other. The indoor unit controller 22 is also connected to a remote control controller 80 (described later) via a cable C2, and transmits and receives signals with each other. The indoor unit controller 22 receives a predetermined signal from the outdoor unit controller or the remote control controller 80, and then carries out processing that corresponds to the signal.

(1-3) Remote Control 30

Figure 3:
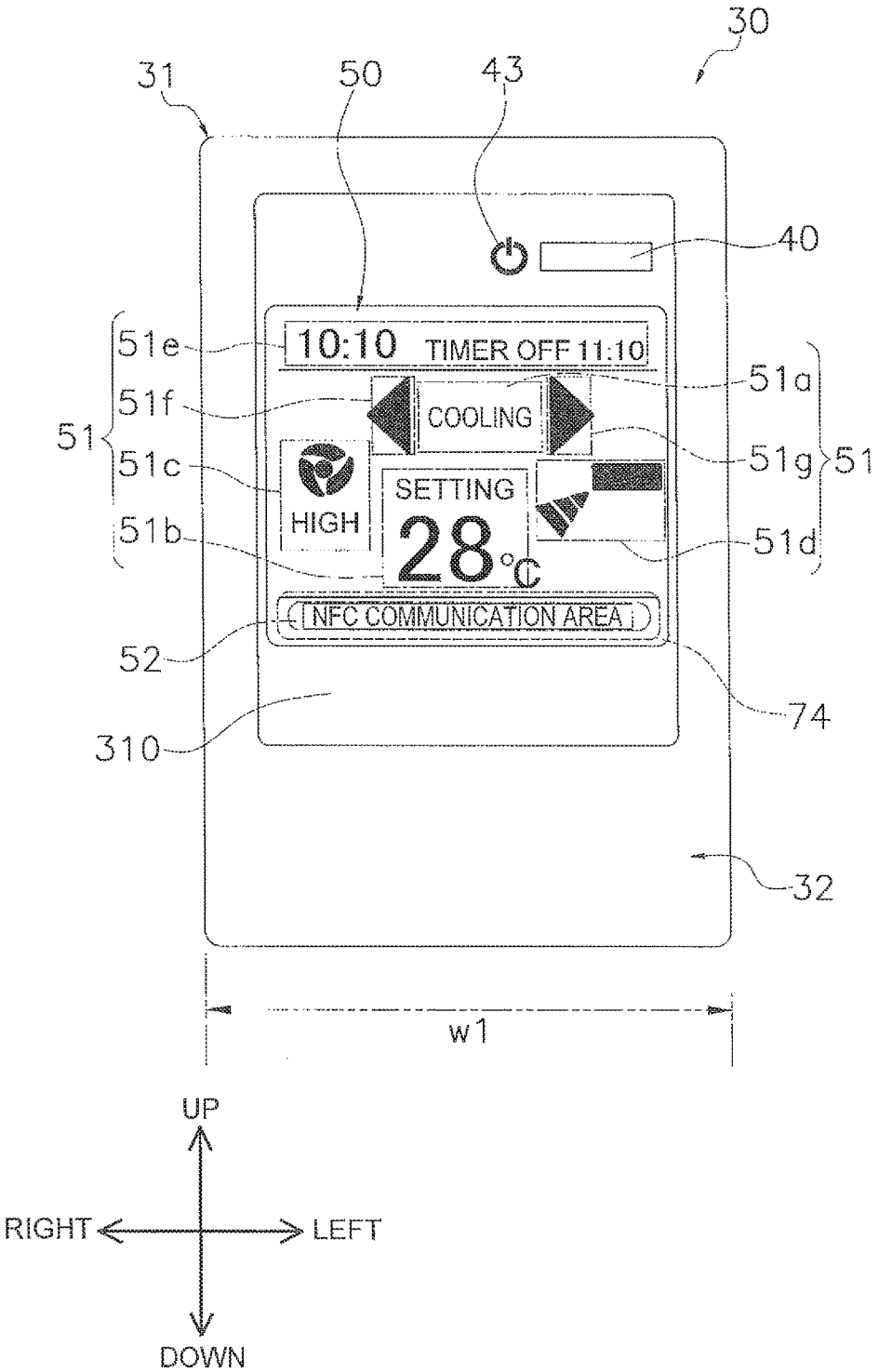
FIG. 3 is a front surface view of the remote control device in the installed state.
Figure 4:
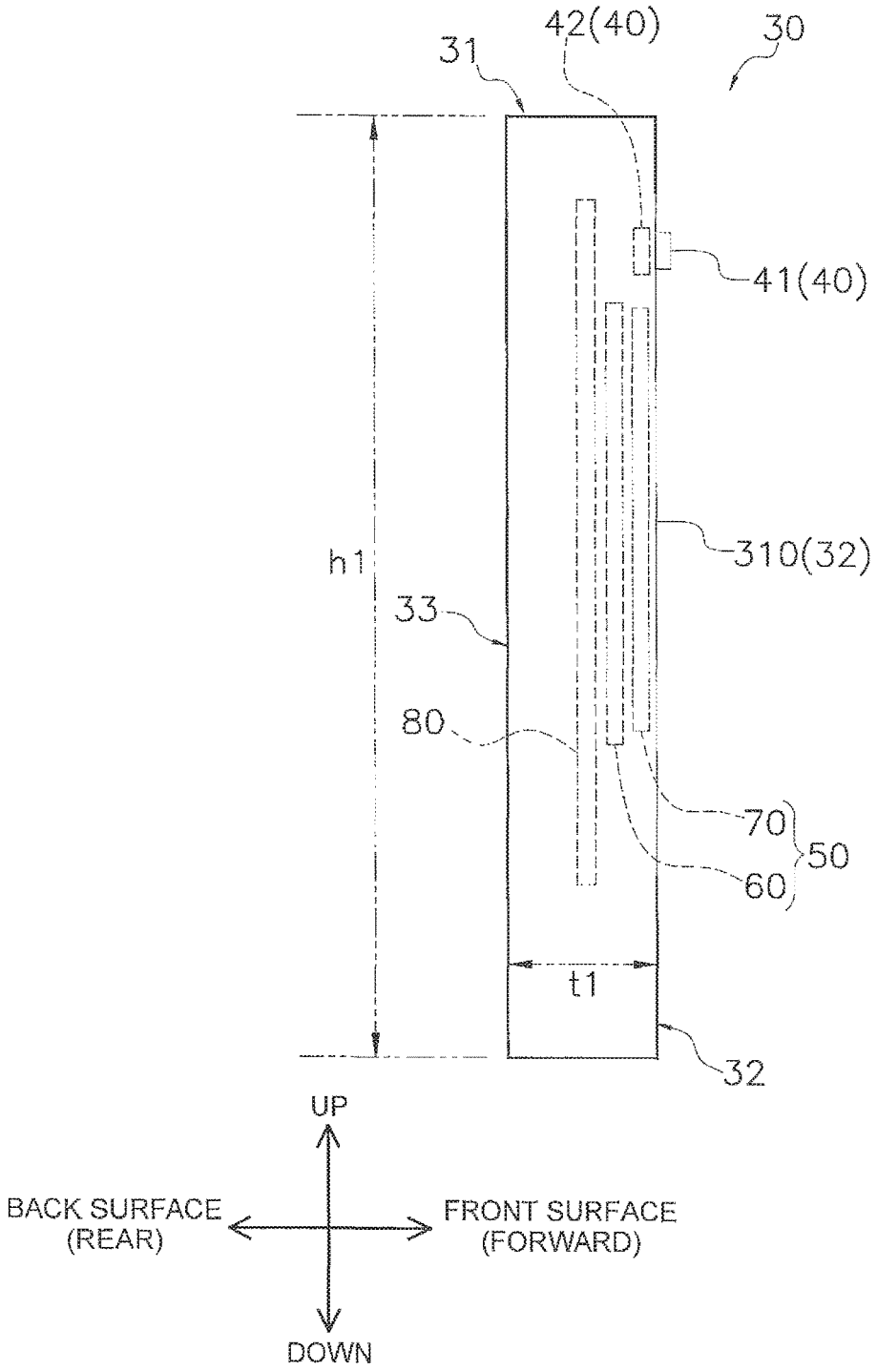
FIG. 4 is a right-side surface view of the remote control device in the installed state.
Figure 5:
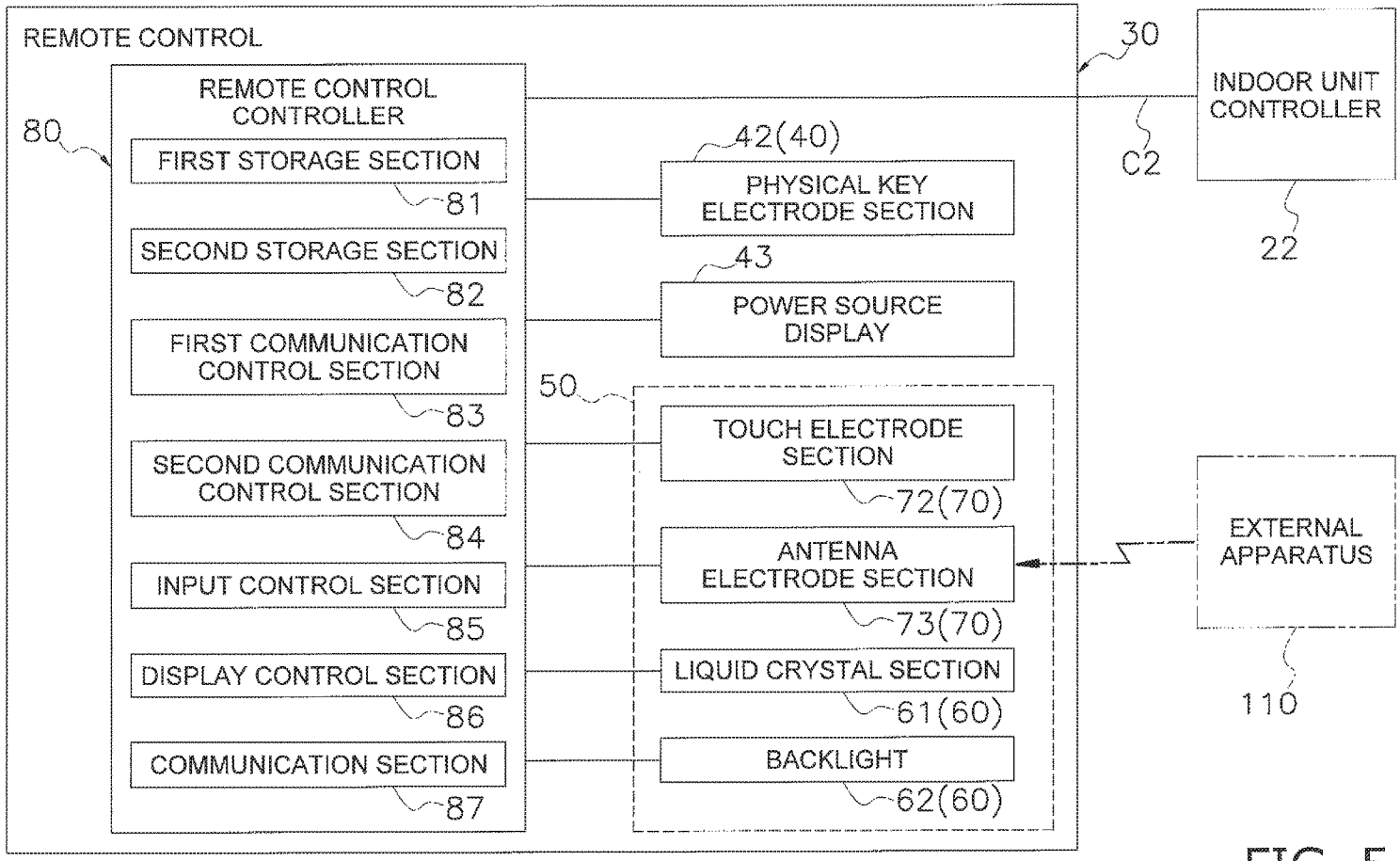
FIG. 5 is a schematic structural view of the remote control device.

FIG. 3 is a front surface view of the remote control 30 in the installed state. FIG. 4 is a right-side surface view of the remote control 30 in the installed state. FIG. 5 is a schematic structural view of the remote control 30.

The remote control 30 is a so-called wired remote control device and is connected to the indoor unit controller 22 via the cable C2. The remote control 30 is connected to the indoor power source section so as to be provided with a power source. The remote control 30 is installed on, e.g., an indoor inner wall. In the present embodiment, the remote control 30 is secured to the sidewall SW of an indoor space SI via a mounting member (not shown).

The remote control 30 functions as an interface for starting and stopping the operation of the air-conditioning system 100, and for inputting to the air-conditioning system 100 various instructions for switching or modifying the operation mode, temperature setting, airflow volume, airflow direction, timer setting, time or display language, and other settings. For example, with the remote control 30, it is possible to input various instructions using a physical key 40 (described later) or a touch panel 70 (described later). It is also possible to transmit control signals by near field communication from an external apparatus 110 to thereby send various instructions to the remote control 30.

The external apparatus 110 (corresponding to the "communication device" in Claims) is an apparatus provided with an antenna for wireless communication. The external apparatus 110 is envisioned to be a smartphone, tablet PC, or other information terminal in the present embodiment. But the external apparatus 110 may also be another PC and/or card, or the like. Near field communication (NFC) is a communication scheme that enables bidirectional communication at a short distance of several centimeters to about one meter using a frequency of 13.56 MHz, and is an international standard.

The remote control 30 functions as a display device for displaying the operating state and/or setting items of the air-conditioning system 100. For example, the remote control 30 displays, in a predetermined display language, the operating mode, the temperature setting, settings for airflow volume and direction, timer setting, time, and other setting items of the air-conditioning system 100 in an operating state.

The remote control 30 also functions as an interface for updating various control programs in the air-conditioning system 100. For example, when the control program for the outdoor unit controller, the indoor unit controller 22, or the remote control controller 80 has been updated, the remote control 30 is capable of acquiring the updated program by near field communication with the external apparatus 110.

(2) Detailed Description of the Remote Control 30

The remote control 30 has a casing 31 made of synthetic resin or the like. The casing 31 is a thin enclosure in which a thickness t1 (length in the thickness direction) is less than a height h1 (length in the longitudinal direction) and a width w1 (length in the lateral direction). The casing 31 presents an essentially rectangular shape as seen from the front surface. The casing 31 includes a front surface part 32 constituting one principal plane, and a back surface part 33 constituting another principal plane. The front surface part 32 and the back surface part 33 are facing each other. The front surface part 32 faces the indoor space SI (forward) direction and the back surface part 33 faces the sidewall SW (rear) direction when the remote control 30 is installed on the sidewall SW.

The casing 31 has a transparent cover 310 composed of glass, acrylic resin, or the like. The cover 310 is disposed in the center portion of the front surface part 32. In other words, the front surface part 32 includes the cover 310. The cover 310 can also be said to constitute a portion of the front surface part 32.

The remote control 30 mainly has a physical key 40, a power source display 43, a touch screen 50, and a remote control controller 80 inside the casing 31.

(2-1) Physical Key 40, Power Source Display 43

The physical key 40 is a pushbutton in which a user inputs instructions for starting and stopping the operation of the air-conditioning system 100. Specifically, the air-conditioning system 100 starts operating when the physical key 40 is pressed downward during the air-conditioning system 100 is in a stopped state. The air-conditioning system 100 stops when the physical key 40 is pressed downward during the air-conditioning system 100 is in an operating state.

The physical key 40 is disposed in the upper left part of the front surface side of the casing 31. The physical key 40 includes a key top 41 and a physical key electrode section 42. The key top 41 is exposed to the front surface side from an opening formed in the casing 31. The physical key electrode section 42 is connected to the remote control controller 80 and a predetermined signal is outputted to the remote control controller 80 when the physical key 40 is pressed downward.

The power source display 43 is an LED or other light-emitting part. The power source display 43 is disposed adjacent to the physical key 40. The actuation of the power source display 43 is controlled by the remote control controller 80. Specifically, the power source display 43 is lighted when the air-conditioning system 100 is in an operating state and is off when the air-conditioning system is in a stopped state.

(2-2) Touch Screen 50

The touch screen 50 is disposed in the center portion of the front surface side of the remote control 30. Specifically, the touch screen 50 is disposed near the back surface side of the cover 310.

The touch screen 50 functions as input means for inputting various instructions in the remote control 30. Specifically, the touch screen 50 has a first touch input section 51*a*, a second touch input section 51*b*, a third touch input section 51*c*, a fourth touch input section 51*d*, a fifth touch input section 51*e*, a sixth touch input section 51*f*, and a seventh touch input section 51*g* (these are hereinafter generically referred to as touch input sections 51). The touch input sections 51 are associated with various instructions, and the user can input a instruction by touching the touch input sections 51 with a finger, a stylus pen or the like.

For example, the operating mode can be set by touching the first touch input section 51*a*. The temperature setting can be set by touching the second touch input section 51*b*. The airflow volume can be set by touching the third touch input section 51*c*. The airflow direction can be set by touching the fourth touch input section 51*d*. The timer or time can be set by touching the fifth touch input section 51*e*. The level, the mode or the like of currently selected setting items can be modified by touching the sixth touch input section 51*f* or the seventh touch input section 51*g*.

The touch screen 50 functions as display means for displaying various types of information. Specifically, the touch screen 50 displays predetermined icons and information so as to overlap the touch input sections 51 during the operating state. This display allows a user to identify various instructions associated with the touch input sections 51.

For example, the selected operating mode is displayed so as to overlap the first touch input section 51*a* (In FIG. 3, the term "COOLING" indicating that the air-cooling mode has been selected is displayed ). The selected temperature setting is displayed so as to overlap the second touch input section 51*b* (In FIG. 3, the description "SETTING 28° C." indicating the selected temperature setting is displayed.). The selected airflow volume is displayed so as to overlap the third touch input section 51*c* (In FIG. 3, the term "HIGH"

and an icon indicating the selected airflow volume setting are displayed.). The selected airflow direction is displayed so as to overlap the fourth touch input section 51*d* (In FIG. 3, an icon indicating the selected airflow direction is displayed.). The current time and timer-off time arc displayed so as to overlap the fifth touch input section 51*e* (In FIG. 3, the descriptions and numbers indicating the current time "10.10" and the selected the timer-off time "TIMER OFF 11.10" are displayed.). An icon indicating a cursor is displayed so as to overlap the sixth touch input section 51*f* and the seventh touch input section 51*g*.

The touch screen 50 also functions as an interface for near field communication with the external apparatus 110. Specifically, an antenna section 52 that functions as an antenna for near field communication is configured in the lower part of the touch screen 50. The remote control 30 is thereby capable of near field communication with the external apparatus 110. In the touch screen 50, the description "NFC COMMUNICATION AREA" is displayed so as to overlap the antenna section 52, and the user is able to confirm the position of the antenna section 52 when near field communication is to be carried out (see FIG. 3).

The touch screen 50 mainly includes a liquid crystal display 60 and the touch panel 70.

(2-2-1) Liquid Crystal Display 60

The liquid crystal display 60 is disposed so as to be sandwiched between the touch panel 70 and the remote control controller 80 inside the casing 31. Specifically, the liquid crystal display 60 has a full dot matrix liquid crystal section 61 (hereinafter referred to as liquid crystal section 61) and a primary tri color LED backlight 62 (hereinafter referred to as backlight 62).

The liquid crystal section 61 includes a liquid crystal and a liquid-crystal-driving electrode section (not shown). The liquid crystal section 61 is electrically connected to the remote control controller 80. Actuation of the liquid crystal section 61 is controlled by the remote control controller 80.

The liquid crystal display 60 is capable of switching the brightness and color of the backlight 62 in accordance with the supplied electric current. In the present embodiment, the liquid crystal display 60 is capable of switching the brightness of the backlight 62 in the two steps of high and low, and switching the color of the backlight 62 in the three colors of blue, green, and red. The liquid crystal display 60 is electrically connected to the remote control controller 80. The liquid crystal section 61 is driven and the brightness and color of the backlight 62 are switched with predetermined timing by the remote control controller 80. In the present embodiment the backlight 62 is lighted in blue when the air-conditioning system 100 is carrying out air-cooling and dehumidifying operations, and is lighted in red when the air-conditioning system 100 is carrying out air-warming operation. The backlight 62 is lighted in green when the remote control 30 is wirelessly communicating with the external apparatus 110.

(2-2-2) Touch Panel 70

The touch panel 70 is a so-called capacitive touch panel that detects touch input and a touched position by determining change in the electrostatic capacitance of an electrode or electric field. The touch panel 70 is disposed between the liquid crystal display 60 and the cover 310 so as to be nearer to the front surface part 32 than to the back surface part 33. The touch panel 70 is disposed so as to overlap the liquid crystal display 60 as seen from the front surface part 32 side (front surface side). In other words, the touch panel 70 is disposed so as to overlap the liquid crystal display 60 as seen from the indoor space SI side. The touch panel 70 includes an electrode unit 71.

(2-2-2-1) Electrode Unit 71

Figure 6:
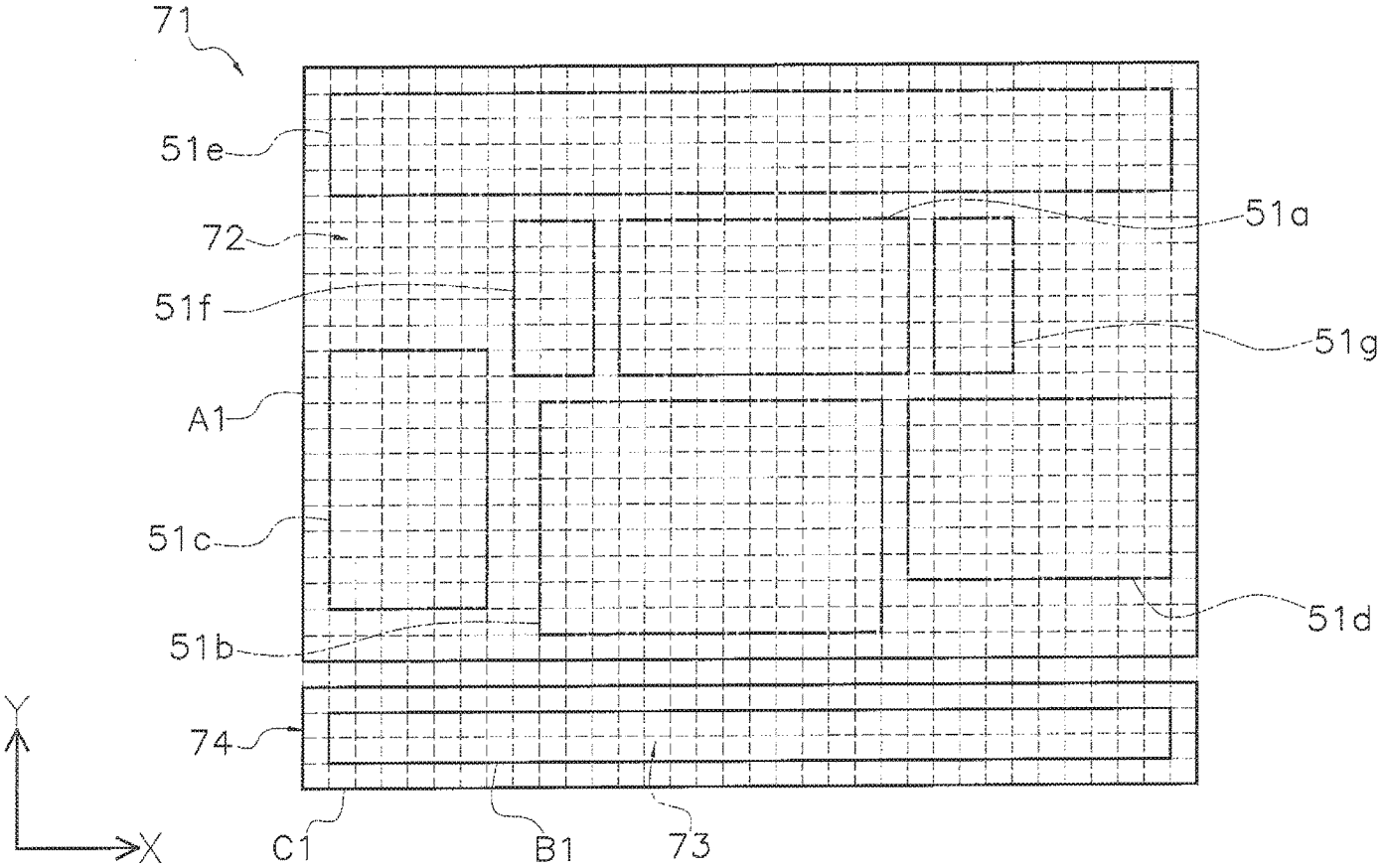
FIG. 6 is a schematic view of an electrode unit.

FIG. 6 is a schematic view of the electrode unit 71. The electrode unit 71 mainly has a transparent substrate on which a plurality of transparent electrodes are arranged for detecting a touched position in the longitudinal direction (Y direction) and another transparent substrate on which a plurality of transparent electrodes are arranged for detecting a touched position in the lateral direction (X direction). These two transparent substrates overlapping with each other. Viewing the electrode unit 71 from the front surface side (front surface part side), the plurality of electrodes are lined up in predetermined intervals in the X-axis direction and the Y-axis direction.

The electrode unit 71 is arranged adjacent to the cover 310 (i.e., directly behind the cover 310) of the front surface part 32. In other words, the electrode unit 71 is arranged on the front surface side of the remote control 30.

The electrode unit 71 includes a touch electrode section 72 (corresponding to the "first electrode section" of Claims) constituting the touch input sections 51, an antenna electrode section 73 (corresponding to the "second electrode section" of Claims) constituting the antenna section 52, and a ground section 74. Specifically, in FIG. 6, the touch electrode section 72 is the area surrounded by a boundary line A1. The antenna electrode section 73 is the area surrounded by a boundary line B1. The ground section 74 is a ground pattern formed along the boundary line C1, and is connected to ground.

In this manner, the touch electrode section 72, the antenna electrode section 73, and the ground section 74 are configured in the electrode unit 71. In other words, the touch electrode section 72 and the antenna electrode section 73 are composed of the same constituents in the same electrode unit 71.

The touch electrode section 72 and the antenna electrode section 73 are nearer to the front surface part 32 than to the back surface part 33 inside the casing 31. In other words, the touch electrode section 72 and the antenna electrode section 73 are disposed on the front surface side of the remote control 30.

The touch electrode section 72 and the antenna electrode section 73 are disposed so as not to overlap with each other as seen from the front surface part 32 side (front surface side). The touch electrode section 72 and the antenna electrode section 73 can also be said to be disposed so as not to overlap with each other as seen from the indoor space SI side. In this manner, the touch electrode section 72 and the antenna electrode section 73 are disposed so as not to overlap with each other as seen from the front surface part 32 side or the indoor space SI side.

Each electrode inside the touch electrode section 72 function as electrodes for detecting a touched position on the touch panel 70. Specifically, the electrodes inside the touch electrode section 72 are electrically connected to the remote control controller 80, and when the electro-capacitance or electric field changes, the amount of change is detected by the remote control controller 80. On the basis of the amount of change, the remote control controller 80 detects the touch input and the touched position when the touch input sections 51 have been touched.

The electrodes inside the antenna electrode section 73 function as an antenna for wireless communication with the external apparatus 110. Specifically, the electrodes inside the antenna electrode section 73 are electrically connected to the remote control controller 80, and when the electro-capacitance or electric field changes, the amount of change is detected by the remote control controller 80. On the basis of the amount of change, when a signal has been transmitted from the external apparatus 110, the remote control controller 80 detects and receives the signal. The electrodes in the antenna electrode section 73 are changed in electrostatic capacitance or in the electric field by the remote control controller 80. The remote control controller 80 can thereby transmit a signal to another communication apparatus.

Thus, a portion of the plurality of electrodes included in the electrode unit 71 is used as an antenna for wireless communication with the external apparatus 110. In other words, in the present embodiment, a portion of the plurality of electrodes originally functioning as electrodes for detecting a touched position is used as an antenna for wireless communication.

The ground section 74 is positioned between the touch electrode section 72 and the antenna electrode section 73 as seen from the front surface part 32 side (front surface side), and is disposed so as to surround the antenna electrode section 73. The ground section 74 can be said to be positioned between the touch electrode section 72 and the antenna electrode section 73 as seen from the indoor space SI side. By being disposed in this manner, the ground section 74 serves to restrain electromagnetic interference between the touch electrode section 72 and the antenna electrode section 73.

(2-3) Remote Control Controller 80

The remote control controller 80 (corresponding to "touch detector" and "backlight controller" of Claims) includes a microcomputer composed of a CPU, memory and the like, and various electric components. The remote control controller 80 is mounted on a substrate. The remote control controller 80 is connected to the indoor unit controller 22 via the cable C2, is transmitted electric power and transceives signals. The remote control controller 80 is connected to the physical key electrode section 42, the power source display 43, and the touch screen 50 (the liquid crystal display 60 and the touch panel 70) via wiring. The remote control controller 80 has a normal mode and a wireless communication mode as control modes. The wireless communication mode is a control mode selected during near field, communication with the external apparatus 110, and the normal mode is a control mode selected for other cases.

The remote control controller 80 mainly includes a first storage section 81, a second storage section 82, a first communication control section 83, a second communication control section 84, an input control section 85, a display control section 86, and a communication section 87.

(2-3-1) First Storage Section 81, Second Storage Section 82

The first storage section 81 and the second storage section 82 include ROM and/or RAM, or other memory.

The first storage section 81 holds control programs that are used in each section of the remote control controller 80. The control programs are programmed with processes for each section in the remote control controller 80.

The second storage section 82 is a "working memory," and saves information from each section in a predetermined area. The second storage section 82 also holds most recent information (hereinafter referred to as "settings information") selected by the user information for several past events (hereinafter referred to as "operation history information") in relation to predetermined setting items (operating mode, temperature setting, airflow volume setting, airflow direction, timer setting, time, display language, and the like). The settings information and operation history information held in second storage section 82 are updated in real time.

(2-3-2) First Communication Control Section 83

When predetermined information is saved in the second storage section 82, the first communication control section 83 acquires the information and carries out predetermined processing. Specifically, the first communication control section 83 acquires physical key input information when the air-conditioning system 100 is stopped, and then outputs a predetermined control signal to the indoor unit controller 22 via the communication section 87 in accordance with the settings information saved in the second storage section 82.

The first communication control section 83 receives, via the communication section 87, signals outputted from the indoor unit controller 22, and then decodes and saves the decoded information in the second storage section 82.

(2-3-3) Second Communication Control Section 84

The second communication control section 84 detects a change in electrostatic capacitance or electric field in the antenna electrode section 73, and determines whether a signal has been transmitted from the external apparatus 110 to the antenna electrode section 73 (antenna section 52) on the basis of the amount of change. More specifically, the second communication control section 84 detects signals at a frequency of 13.56 MHz transmitted to the antenna electrode section 73 (antenna section 52), and saves the information for switching from normal mode to wireless communication mode (hereinafter referred to as "wireless communication mode transition information") in the second storage section 82.

The second communication control section 84 decodes the signal transmitted from the external apparatus 110 and saves the decoded information (hereinafter referred to as "wireless communication information") in the second storage section 82. The second communication control section 84 causes a change in the electrostatic capacitance or electric field of the antenna electrode section 73 at predetermined timing during execution of the wireless communication mode to thereby transmit a signal at the frequency of 13.56 MHz to the external apparatus 110.

After completing near field communication with the external apparatus 110, the second communication control section 84 saves the information for switching from wireless communication mode to normal mode (hereinafter referred to as "wireless communication mode cancellation information") in the second storage section 82.

(2-3-4) Input Control Section 85

The input control section 85, upon receiving signal input from the physical key electrode section 42, saves predetermined information (hereinafter this is referred to as "physical key input information") in the second storage section 82.

When wireless communication mode transition information has not been saved in the second storage section 82 or when the wireless communication mode cancellation information has been saved, the input control section 85 acquires the information and performs processing that corresponds to the normal mode. Specifically, in the normal mode, the input control section 85 detects change in the electrostatic capacitance or electric field of the touch electrode section 72, determines touch input to the touch input sections 51 on the basis of the amount of change, and specifies the touch input section 51 that has received touch input. The input control section 85 saves the predetermined information (hereinafter, this information is referred to as "touch input information") in the second storage section 82 in accordance with the touch input section 51 that has received touch input.

When the wireless communication mode transition information has been stored in the second storage section 82, the input control section 85 acquires the information and carries out processing that corresponds to the wireless communication mode. Specifically, in the wireless communication mode, the input control section 85 stops detecting change in the electrostatic capacitance or electric field of the touch electrode section 72.

(2-3-5) Display Control Section 86

When the predetermined information has been saved in the second storage section 82, the display control section 86 acquires the information and performs the predetermined processing. Specifically, the display control section 86, upon acquiring the physical key input information when the air-conditioning system 100 is in a stopped state, lights the power source display 43 and the backlight 62 with a predetermined brightness and color, and drives the liquid crystal section 61 on the basis of the settings information saved in the second storage section 82. The display control section 86 turns off the power source display 43 and the backlight 62 when the physical key input information has been received when the air-conditioning system 100 is in an operating state When the wireless communication mode transition information is not saved or when the wireless communication mode cancellation information is saved in the second storage section 82, the display control section 86 acquires the information and performs processing corresponding to the normal mode. Specifically, when the touch input information is acquired in the normal mode, the display control section 86 drives the liquid crystal section 61 on the basis of the settings information saved in the second storage section 82.

When the wireless communication mode transition information has been stored in the second storage section 82, the display control section 86 acquires the information and performs processing that corresponds to the wireless communication mode. Specifically, the display control section 86 lights the backlight 62 in green in the wireless communication mode. During the wireless communication mode, the display control section 86 does not drive the liquid crystal section 61. Accordingly, backlight 62 is lighted in green without icons and characters and the like being displayed on the liquid crystal display 60 during wireless communication mode.

(2-3-6) Communication Section 87

Communication section 87 is communication circuit for outputting to the indoor unit controller 22 the signal inputted from the first communication control section 83, and outputting to the first communication control section 83 the signal inputted from the indoor unit controller 22.

(3) Processing Flow of Remote Control Controller 80

Figure 7:
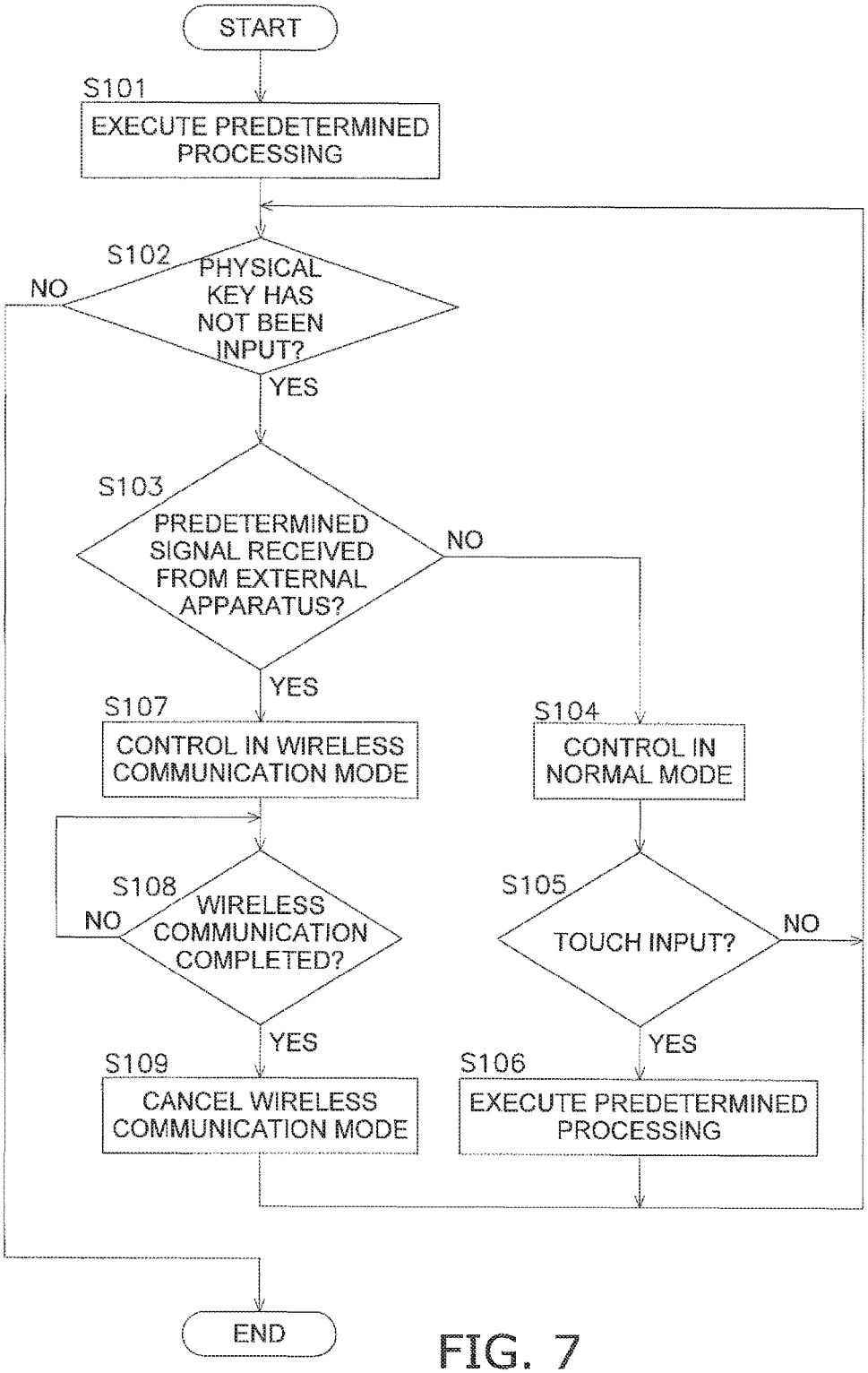
FIG. 7 is a flowchart showing an example of the processing flow carried out by the remote control controller.

An example of the flow of process carried out by the remote control controller 80 is described below with reference to FIG. 7.

In step S101, when the physical key 40 is pressed down in the situation the air-conditioning system 100 is stopped, the remote control controller 80 lights the power source display 43. Also, the remote control controller 80, on the basis of the settings information, drives the liquid crystal section 61 and lights the backlight 62. Furthermore, the remote control controller 80 transmits a control signal to the indoor unit controller 22 to start operation on the basis of the settings information. The process thereafter proceeds to step S102.

In step S102, the remote control controller 80 determines whether the physical key 40 has not been pressed down. When the determination is NO (i.e., when the physical key 40 has been pressed down), the remote control controller 80 transmits a control signal to stop the operation of the indoor unit controller 22, and then stops driving the liquid crystal section 61, stops lighting the backlight 62, turns off the power source display 43, and ends processing. Conversely, when the determination is YES (i.e., when the physical key 40 has not been pressed down), the process proceeds to step S103.

In step S103, the remote control controller 80 determines whether a predetermined signal has been transmitted to the antenna section 52 (i.e., whether the electrostatic capacitance or electric field of the antenna electrode section 73 has changed by a predetermined amount). When the determination is NO (i.e., when a predetermined signal has not been transmitted to the antenna section 52), the process proceeds to step S104. Conversely, when the determination is YES (i.e., when a predetermined signal has been transmitted to the antenna section 52), the process proceeds to step S107.

In step S104, the remote control controller 80 sets the control mode to the normal mode. The process thereafter proceeds to step S105.

In step S105, the remote control controller 80 determines whether there has been a touch input to the touch input sections 51 (i.e., whether the electrostatic capacitance or electric field in a predetermined position of the touch electrode section 72 has changed in by a predetermined amount). When the determination is NO, (i.e., when there has not been a touch input to the touch input sections 51), the process returns to step S102. Conversely, when the determination is YES (i.e., when there has been a touch input to the touch input sections 51), the process proceeds to step S106.

In step S106, the remote control controller 80, on the basis of the settings information, drives the liquid crystal section 61 and lights the backlight 62. The remote control controller 80 also transmits to the indoor unit controller 22 a control signal to start operation on the basis of the settings information. The process thereafter returns to step S102.

In step S107, the remote control controller 80 sets the control mode to the wireless communication mode. The remote control controller 80 then stops driving the liquid crystal section 61 and lights the backlight 62 in green. The remote control controller 80 also stops detection of touch input to the touch input sections 51. The remote control controller 80 then transmits and receives signals by near field communication with the external apparatus 110. The process thereafter proceeds to step S108.

In step S108, when wireless communication has not been completed, near field communication with the external apparatus 110 is continued. Conversely, when wireless communication has been completed, the process proceeds to step S109.

In step S109, the remote control controller 80 cancels the wireless communication mode. The process thereafter returns to step S102.

(4) Information Transmitted and Received in Near Field Communication

As described above, it is possible for near field communication to be carried out between the remote control 30 and the external apparatus 110. The information to be transmitted and received during wireless communication is not particularly limited, and various types of information can be transmitted and received.

For example, it is possible for various instructions to be transmitted from the external apparatus 110 to the remote control 30, including instructions for starting and stopping the air-conditioning system 100, and for modifying or switching the operating mode, the temperature setting, airflow volume setting, airflow direction, timer setting, time, display language, or the like. When the control program for the outdoor unit controller, the indoor unit controller 22, or the remote control controller 80 has been updated, the updated control program can be transmitted from the external apparatus 110 to the remote control 30. When a security lock function has been provided to the remote control 30 to allow input only from a specific operator, predetermined information for cancelling the security lock can be transmitted from the external apparatus 110 to the remote control 30. It is also possible for operation history information to be transmitted from the air-conditioning system 100 to the external apparatus 110 in order to obtain the operation history of the air-conditioning system 100.

(5) Functions of the Remote Control 30

In the remote control 30, a portion of the electrode unit 71 included in the touch panel 70 functions as the touch electrode section 72, and another portion functions as the antenna electrode section 73. Accordingly, an antenna for near field communication is not required to be disposed in addition to the touch panel 70, costs are restrained, and the remote control 30 is made more compact.

In the remote control 30, the antenna electrode section 73 is disposed on the front surface side of the remote control 30. As a result, signal transmission and receiving can be readily carried out smoothly between the antenna section 52 and the antenna mounted in the external apparatus 110 when near field communication is carried out with the external apparatus 110.

In the remote control 30, a ground section 74 is provided between the touch electrode section 72 and the antenna electrode section 73. As a result, electromagnetic interference is not likely to occur between the antenna electrode section 73 and the touch electrode section 72, and noise to the antenna electrode section 73 is reduced.

In the remote control 30, detection of changes in the electrostatic capacitance or electric field in the touch electrode section 72 is stopped during the interval of control in the wireless communication mode. In other words, in the remote control 30, detection of touch input to the touch input sections 51 is not carried out in the interval in which wireless communication is being carried out with the external apparatus 110. As a result, the antenna electrode section 73 is less likely to be affected by noise during wireless communication with the external apparatus 110.

In the remote control 30, the liquid crystal display 60 lights the backlight 62 in green in the interval of control in the wireless communication mode. As a result, when wireless communication is being earned between the remote control 30 and the external apparatus 110, an operator can more readily recognize that wireless communication is being carried out. In other words, when wireless communication is being carried out, the liquid crystal display 60 (backlight 62) functions as a display for indicating that wireless communication is being performed.

The antenna electrode section 73 is less likely to be affected by noise from the liquid crystal section 61 because icons and characters or the like are not displayed on the liquid crystal display 60 in the interval of control in the wireless communication mode.

(6) Characteristics (6-1)

In the embodiment described above, the touch panel 70 of the remote control 30 includes an electrode unit 71, and the electrode unit 71 has a touch electrode section 72 that functions as electrodes for detecting a touched position, and an antenna electrode section 73 that functions as an antenna for carrying out near field communication with an external apparatus 110. In other words, in the embodiment described above, a portion of a plurality of electrodes that normally function as electrodes for detecting a touched position is used as an antenna for wireless communication. In this manner, a portion of the electrode unit 71 of the touch panel 70 functions as an antenna for near field communication, and as a result, in the remote control 30, an antenna for near field communication is not required in addition to the electrode unit 71 of the touch panel 70, and costs are restrained.

In the embodiment described above, the touch electrode section 72 and the antenna electrode section 73 are nearer to the front surface part 32 than to the back surface part 33 in the casing 31, and are disposed so as not to overlap with each other as seen from the front surface part 32 side. The antenna electrode section 73 thereby readily demonstrates a function as an antenna in near field communication.

In the embodiment described above, the touch electrode section 72 functioning as an antenna is disposed on the front surface part 32 side (front surface side of the main body) of the remote control 30, and the surface area of the liquid crystal display 60 (display) does not need to be reduced and a degradation of operability is restrained.

(6-2)

In the embodiment described above, the touch panel 70 includes a ground section 74 positioned between the touch electrode section 72 and the antenna electrode section 73 as seen from the front surface part 32 side. The antenna electrode section 73 is thereby less likely to be affected by noise from the touch electrode section 72.

(6-3)

In the embodiment described above, a remote control controller 80 for detecting a touched position on the touch panel 70, and the remote control controller 80 stops detection of touch input while wireless communication is being earned out with the external apparatus 110. The antenna electrode section 73 is thereby less likely to be affected by noise during wireless communication with the external apparatus 110, and decline in communication performance is restrained.

(6-4)

In the embodiment described above, the remote control controller 80 lights the backlight 62 of the liquid crystal display 60 in a predetermined color during wireless communication with the external apparatus 110. As a result, in the interval in which wireless communication is being carried out, it is indicated to the operator that wireless communication is being performed. The operator can thereby more readily recognize that wireless communication is being carried out when wireless communication is ongoing between the remote control 30 and the external apparatus 110.

(6-5)

In the embodiment described above, near field communication is carried out when various settings of the air-conditioning system 100 made via the external apparatus 110. Operability is thereby improved when various settings of the air-conditioning system 100 are made. The amount of memory to be provided to the remote control 30 can also be reduced.

(7) Modifications (7-1) Modification A

In the embodiment described above, the remote control 30 is employed in an air-conditioning system 100, but no limitation is imposed thereby. For example, the remote control 30 may be used in a water heater, dehumidifier, or other heat pump system. The remote control 30 may also be used in a ventilating device, an air cleaner, or the like.

(7-2) Modification B

In the embodiment described above, the indoor unit 20 is a so-called ceiling-embedded-type, but no limitation is imposed thereby, it is also possible to use, e.g., a ceiling-suspended-type, a wall-mounted-type, or a floor type indoor unit.

(7-3) Modification C

In the embodiment described above, the remote control 30 is connected to the indoor unit controller 22 of a single indoor unit 20. But no limitation is imposed thereby; the remote control 30 may be connected to the each indoor unit controller 22 of a plurality of indoor units 20.

Also, the remote control 30 is connected to the indoor unit controller 22 of the indoor unit 20 by way of a cable C2 to carry out communication. However, no limitation is imposed thereby, wireless communication by infrared or the like may be employed. In such a case, the cable C2 can be omitted, and a battery or other power source can be installed in the remote control 30 to provide a power source to the components of the remote control 30.

The remote control 30 may also be connected to the outdoor unit controller rather than to the indoor unit controller 22. In such a case, signals from the remote control 30 are transmitted to the indoor unit controller 22 by way of the outdoor unit controller.

(7-4) Modification D

In the embodiment described above, the remote control 30 is installed on a sidewall SW. However, the remote control 30 is not necessarily required to be installed on a sidewall SW. For example, the remote control 30 may be installed in another location. Also, the remote control 30 is not necessarily required to be installed in a specific location.

In the embodiment described above, the remote control 30 is employed as a remote control device. However, no limitation is imposed thereby; e.g., a smartphone, a tablet PC, or other information terminal may be used as the remote control device.

(7-5) Modification E

In the embodiment described above, wireless communication carried out between the remote control 30 and the external apparatus 110 is performed by near field communication (NFC), but no limitation is imposed thereby. For example, it is also possible to used wireless communication based on ISO/IEC 14443, Bluetooth® or another communication protocol.

(7-6) Modification F

In the embodiment described above, the backlight 62 is lighted in green to indicate to the operator that wireless communication is being carried out when wireless communication is being performed with the external apparatus 110. But the color for lighting the backlight 62 is not particularly limited; another color may be used. In such a case, the backlight 62 may also be made to blink in a constant cycle. Also, in this case, the liquid crystal section 61 may be driven and icons or characters may be displayed on the liquid crystal display 60 to indicate that wireless communication is being carried out.

In this case, the power source display 43 may be lighted or made to blink in a predetermined color with or without lighting the backlight 62. In such a case, when wireless communication is being carried out, the power source display 43 functions as a display indicating that wireless communication is being performed. A LED or other display may be arranged in addition to the backlight 62 or the power source display 43, and these may be lighted or made to blink during wireless communication.

(7-7) Modification G

In the embodiment described above, the antenna electrode section 73 is provided to the electrode unit 71 of the touch panel 70. However, no limitation is imposed thereby; the remote control 30 may be configured with the antenna electrode section 73 provided to the liquid-crystal-driving electrodes of the liquid crystal section 61.

(7-8) Modification H

In the embodiment described above, the each touch input sections 51 (touch electrode section 72), the antenna section 52 (antenna electrode section 73), and the ground section 74 are disposed in predetermined positions in the electrode unit 71, as shown in FIGS. 3 or 6. However, the arrangement of the each touch input sections 51 (touch electrode section 72), the antenna section 52 (antenna electrode section 73), and the ground section 74 is not limited thereto, any mode can be used. For example, the touch input sections 51 (touch electrode section 72), the antenna section 52 (antenna electrode section 73), and the ground section 74 may be disposed in a mode such as that shown in FIG. 8.

Figure 8:
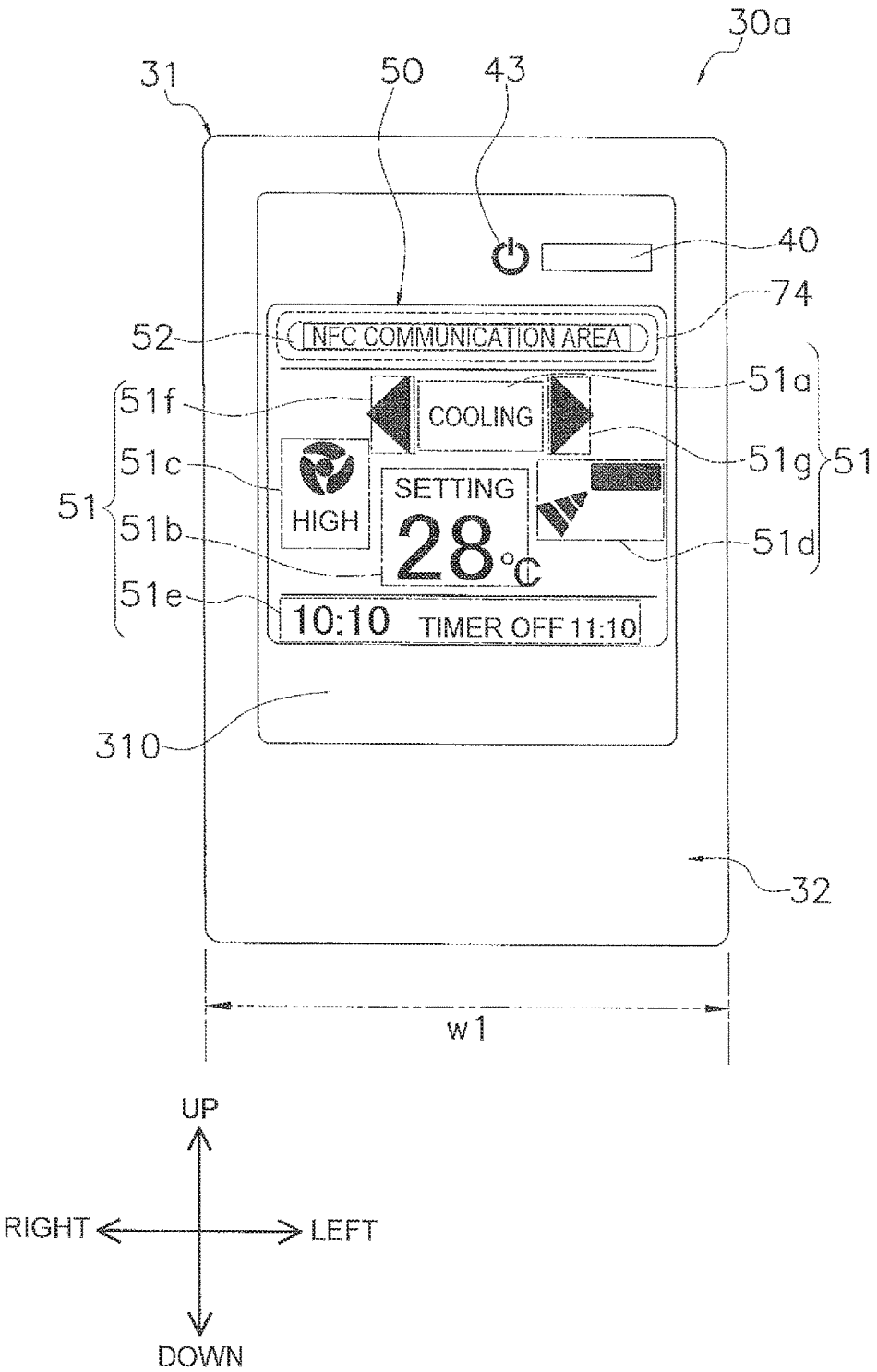
FIG. 8 is a front surface view of the remote control device according to the modification H.

In the remote control 30*a*, shown in FIG. 8, the antenna, section 52 (antenna electrode section 73) is disposed in the position of the fifth touch input section 51*e* of the remote control 30 and is positioned above the each touch input sections 51 (touch electrode section 72). In accompaniment therewith, the ground section 74 is also positioned above the each touch input sections 51 (touch electrode section 72), and is disposed so as to surround the antenna section 52 (antenna electrode section 73) between the touch electrode section 72 and the antenna electrode section 73. Also, the fifth touch input section 51*e* is disposed in the position of the antenna section 52 (antenna electrode section 73) of the remote control 30. Other configurations of the remote control 30*a* are substantially the same as the remote control 30.

(7-9) Modification I

A so-called capacitive touch panel is employed in a touch panel 70. However, another type may be used in the touch panel 70. For example, the touch panel 70 may be a so-called resistive touch panel in which a change in voltage is detected when two opposing electrode substrates make contact with each other by being touched.

INDUSTRIAL APPLICABILITY

The present invention can be used in a remote control device.

What is claimed is:

1. A remote control device installed on a sidewall forming an indoor space, the remote control device being configured to perform wired communication with an air conditioner or a heat pump apparatus, the remote control device comprising:

a touch panel having an electrode unit;

a liquid crystal display; and a casing configured and arranged to accommodate the touch panel and the liquid crystal display, the casing having a back surface part that faces the sidewall in an installed state and a front surface part that faces the indoor space in the installed state, the liquid crystal display being disposed so as to overlap the touch panel as seen from a front surface part side, the electrode unit having a first electrode section configured and arranged to function as an electrode to detect a touched position, and a second electrode section configured and arranged to function as an antenna to perform wireless communication with another communication device, the first electrode section and the second electrode section being configured and arranged to be nearer to the front surface part than to the back surface part inside the casing, and to be disposed so as not to overlap with each other as seen from the front surface part side, and the first electrode section and the second electrode section being configured by same constituents in the electrode unit.

2. The remote control device according to claim 1, wherein the touch panel further has a ground section connected to ground, and the ground section is configured and arranged to be positioned between the first electrode section and the second electrode section as seen from the front surface part side.

3. The remote control device according to claim 1, wherein the wireless communication is near field communication (NFC).

4. The remote control device according to claim 1, further comprising a touch detector configured and arranged to detect the touched position on the touch panel, the touch detector being configured and arranged to stop the detection while wireless communication is being carried out.

5. The remote control device according to claim 1, further comprising a backlight controller configured and arranged to control backlight actuation of the liquid crystal display, the backlight controller being configured and arranged to light a backlight of the liquid crystal display in a predetermined color when the wireless communication is being carried out.

6. The remote control device according to claim 1, wherein the wireless communication is carried out when various settings of the air conditioner or the heat pump apparatus are carried out via the communication device.

7. A remote control device configured to perform communication with an air conditioner or a heat pump apparatus, the remote control device comprising:

a touch panel having an electrode unit;

a liquid crystal display; and a casing configured and arranged to accommodate the touch panel and the liquid crystal display, the casing being an enclosure in which a length in a thickness direction is less than a length in a longitudinal direction and a length in a lateral direction, and the casing having a front surface part configured and arranged to constitute one principal plane and a back surface part configured and arranged to constitute another principal plane and to face the front surface part, the liquid crystal display being disposed so as to overlap the touch panel as seen from a front surface part side, the electrode unit having a first electrode section configured and arranged to function as an electrode to detect a touched position, and a second electrode section configured and arranged to function as an antenna to perform wireless communication with another communication device, the first electrode section and the second electrode section being configured and arranged to be nearer to the front surface part than to the back surface part inside the casing and to be disposed so as not to overlap with each other as seen from the front surface part side, and the first electrode section and the second electrode section being configured by same constituents in the electrode unit.

8. The remote control device according to claim 7, wherein the touch panel further has a ground section connected to ground, and the ground section is configured and arranged to be positioned between the first electrode section and the second electrode section as seen from the front surface part side.

9. The remote control device according to claim 7, wherein the wireless communication is near field communication (NFC).

10. The remote control device according to claim 7, further comprising a touch detector configured and arranged to detect the touched position on the touch panel, the touch detector being configured and arranged to stop the detection while wireless communication is being carried out.

11. The remote control device according to claim 7, further comprising a backlight controller configured and arranged to control backlight actuation of the liquid crystal display, the backlight controller being configured and arranged to light a backlight of the liquid crystal display in a predetermined color when the wireless communication is being carried out.

12. The remote control device according to claim 7, wherein the wireless communication is carried out when various settings of the air conditioner or the heat pump apparatus are carried out via the communication device.

* * * * *